US008876332B2

(12) United States Patent
Moeck

(10) Patent No.: US 8,876,332 B2
(45) Date of Patent: Nov. 4, 2014

(54) LAMP FOR GENERAL LIGHTING

(75) Inventor: Martin Moeck, Regensburg (DE)

(73) Assignee: Osram Opto Semiconductor GmbH, Regensburg (DE)

( * ) Notice: Subject to any disclaimer, the term of this patent is extended or adjusted under 35 U.S.C. 154(b) by 220 days.

(21) Appl. No.: 13/392,618

(22) PCT Filed: Aug. 12, 2010

(86) PCT No.: PCT/EP2010/061785
§ 371 (c)(1),
(2), (4) Date: Apr. 10, 2012

(87) PCT Pub. No.: WO2011/023569
PCT Pub. Date: Mar. 3, 2011

(65) Prior Publication Data

US 2012/0188764 A1 Jul. 26, 2012

(30) Foreign Application Priority Data

Aug. 27, 2009 (DE) ..... 10 2009 038 864

(51) Int. Cl.

| | |
|---|---|
| ***F21V 21/26*** | (2006.01) |
| ***F21S 6/00*** | (2006.01) |
| ***F21V 21/108*** | (2006.01) |
| *F21S 8/04* | (2006.01) |
| *F21Y 113/02* | (2006.01) |
| *F21V 29/00* | (2006.01) |
| *F21Y 113/00* | (2006.01) |
| *F21Y 105/00* | (2006.01) |
| *F21V 15/01* | (2006.01) |

(52) U.S. Cl.

CPC ..... *F21S 6/002* (2013.01); *F21V 21/108* (2013.01); *F21S 8/04* (2013.01); *F21Y 2113/02* (2013.01); *F21S 6/004* (2013.01); *F21V 29/2218* (2013.01); *F21V 29/2256* (2013.01); *F21Y 2113/00* (2013.01); *F21Y 2105/008* (2013.01); *F21V 29/2262* (2013.01); *F21Y 2105/00* (2013.01); *F21V 15/011* (2013.01)

USPC ..... 362/269; 362/249.02; 362/285

(58) Field of Classification Search

USPC ..... 362/184, 238, 239, 247, 249.02, 362/249.03, 294, 187, 188, 190, 194, 197, 362/200–202, 208, 230, 231, 240–245, 362/249.01, 249.07, 249.11, 269, 276, 285, 362/3, 10, 800, 802, 806

See application file for complete search history.

(56) References Cited

U.S. PATENT DOCUMENTS

| | | | | |
|---|---|---|---|---|
| 4,329,737 | A * | 5/1982 | Triller et al. | 362/555 |
| D274,270 | S | 6/1984 | Pitti | |

(Continued)

FOREIGN PATENT DOCUMENTS

| | | | |
|---|---|---|---|
| CN | 1517587 | A | 8/2004 |
| CN | 1806336 | A | 7/2006 |

(Continued)

OTHER PUBLICATIONS

Japanese Notice of Allowance for JP 2012-525991 mailed Feb. 25, 2014, 2 pages.

*Primary Examiner* — Hargobind S Sawhney
(74) *Attorney, Agent, or Firm* — Slater & Matsil, L.L.P.

(57) ABSTRACT

A lamp includes a lamp housing which has a light exit opening. A light source of a first type is arranged in the lamp housing. A mounting is fastened to the lamp housing and at least one light source of a second type is fastened to the holder. The at least one light source of the second type includes an organic light-emitting diode and the at least one light source of the second type is arranged downstream of the light exit opening in an emission direction.

18 Claims, 9 Drawing Sheets

(56) References Cited

U.S. PATENT DOCUMENTS

| | | | | |
|---|---|---|---|---|
| D282,290 | S | 1/1986 | Scarpa | |
| D327,136 | S | 6/1992 | Tunick | |
| D388,198 | S | 12/1997 | Weber | |
| 5,829,866 | A * | 11/1998 | Stegeman | 362/655 |
| D443,716 | S | 6/2001 | Vong et al. | |
| 7,021,797 | B2 * | 4/2006 | Miñano et al. | 362/355 |
| D523,987 | S | 6/2006 | Dolan | |
| D570,004 | S | 5/2008 | Hawkins et al. | |
| D634,881 | S | 3/2011 | Moeck | |
| 7,993,039 | B2 * | 8/2011 | Nankil et al. | 362/368 |
| 8,113,685 | B2 * | 2/2012 | Waumans et al. | 362/228 |
| 2002/0136025 | A1 * | 9/2002 | Zhang | 362/555 |
| 2002/0158579 | A1 * | 10/2002 | Kai et al. | 313/635 |
| 2004/0188671 | A1 | 9/2004 | Tan et al. | |
| 2007/0279916 | A1 * | 12/2007 | Kobayashi | 362/341 |
| 2008/0007936 | A1 | 1/2008 | Liu et al. | |
| 2009/0251900 | A1 * | 10/2009 | Targetti et al. | 362/291 |
| 2009/0262545 | A1 * | 10/2009 | Amelung et al. | 362/487 |
| 2010/0157585 | A1 | 6/2010 | Diekmann et al. | |
| 2011/0116270 | A1 * | 5/2011 | Hofmann | 362/294 |
| 2012/0127722 | A1 * | 5/2012 | Moeck et al. | 362/249.03 |

FOREIGN PATENT DOCUMENTS

| | | | |
|---|---|---|---|
| CN | 300782673 | | 5/2008 |
| DE | G 86 07 738.4 | U1 | 7/1986 |
| DE | 10 2006 060 781 | A1 | 4/2008 |
| DE | 10 2008 019 926 | A1 | 2/2010 |
| DE | 10 2008 057 606 | A1 | 5/2010 |
| JP | 56131614 | U | 10/1981 |
| JP | 61190157 | U | 11/1986 |
| JP | 61193606 | U | 12/1986 |
| JP | 63150807 | | 6/1988 |
| JP | 01060405 | U | 4/1989 |
| JP | 2006196196 | A | 7/2006 |
| JP | 2009206030 | A | 9/2009 |
| WO | 2004104642 | A2 | 12/2004 |
| WO | WO 2008/090492 | A1 | 7/2008 |
| WO | WO 2008090492 | A1 * | 7/2008 |
| WO | WO 2010/054421 | A1 | 5/2010 |

* cited by examiner

LAMP FOR GENERAL LIGHTING

This patent application is a national phase filing under section 371 of PCT/EP2010/061785, filed Aug. 12, 2010, which claims the priority of German patent application 10 2009 038 864.8, filed Aug. 27, 2009, each of which is incorporated herein by reference in its entirety.

SUMMARY OF THE INVENTION

The invention specifies a lamp. The lamp is preferably suitable for general lighting. For example, the lamp is suitable for interior lighting or as a desklamp. The lamp is suitable for being fitted to a ceiling, but can also be used in freestanding form. The lamp is characterized by a high luminous flux of at least 100 lm, preferably at least 500 lm, for example, 1000 lm. The lamp can be suitable for emitting cold-white, neutral-white, warm-white or even colored light and can have a color rendering index Ra of >90. The color or the color locus and/or the color temperature of the light emitted by the lamp can be adjustable.

In accordance with at least one embodiment of the lamp, the lamp comprises a lamp housing, which has a light exit opening. The lamp housing is used, for example, for accommodating a drive apparatus for driving the light sources of the lamp. In addition, the lamp housing can be used for accommodating part of the light source of the lamp. The lamp housing therefore has a light exit opening, from which light generated in the lamp housing can leave the lamp housing. The light source arranged in the lamp housing is in this case covered by the lamp housing, and light generated by the light source can leave the lamp housing only through the light exit opening.

In accordance with at least one embodiment of the lamp, the lamp comprises a light source of a first type, which is arranged in the lamp housing. The light source of the first type may be, for example, a light source which comprises one or more light-emitting diode chips, preferably inorganic light-emitting diode chips. In this case, the light source can consist of at least one unenclosed light-emitting diode chip. In addition, the light source of the first type can alternatively or additionally comprise a discharge lamp and/or an incandescent bulb and/or an energy saving lamp. The light source of the first type can further comprise at least one optical element, such as a reflector or a lens, for example. The optical element can be used for beam shaping of the emitted light. The light source of the first type can therefore be a light module. The light source of the first type is arranged in the lamp housing. The light generated by the light source of the first type during operation of the lamp leaves the lamp housing through the light exit opening in the lamp housing.

In accordance with at least one embodiment of the lamp, the lamp comprises a lampholder, which is fastened on the lamp housing. The lampholder can in this case have an integral or multi-part design. For example, the lampholder comprises at least two rods, which are fastened mechanically on the lamp housing. For example, the lampholder can be welded, caulked or screwed to the lamp housing. The lampholder preferably extends along an emission direction of the light emerging from the light exit opening in the lamp housing. That is to say that the lampholder is arranged, at least in some places, downstream of the light exit opening in an emission direction.

In accordance with at least one embodiment of the lamp, the lamp comprises at least one light source of a second type, which is fastened on the lampholder. The light source of the second type differs from the light source of the first type. That is to say that different types of light sources are preferably used for the light sources of the first type and the light sources of the second type. The light source of the second type is preferably a flat light source, which has an emission face with an area of at least 1 $cm^2$, preferably at least 4.5 $cm^2$, for example 4.9 $cm^2$ or 10 $cm^2$.

The emission of the light from the light source of the second type can in this case also take place from the emission face in two mutually opposite directions. That is to say that light can proceed from a front side and a rear side of the emission face.

In accordance with at least one embodiment of the lamp, the light source of the second type comprises an organic light-emitting diode. The light source of the second type can consist of an organic light-emitting diode, for example. The organic light-emitting diode is intended for emitting white light, for example. For example, during operation of the lamp, the light source of the second type therefore emits white light at a color temperature of between 2500 K and 3000 K, for example, at a color temperature of 2800 K.

In accordance with at least one embodiment of the lamp, the at least one light source of the second type is arranged downstream of the light exit opening of the lamp housing in an emission direction. During operation of the lamp, light from the light source of the first type emerges from the light exit opening in the lamp housing. The light source of the first type is the primary light source of the lamp. The direction of the emerging light is the emission direction. The light sources of the second type are arranged downstream of the light exit opening in the emission direction. For example, the light sources of the second type are arranged downstream of the light exit opening in a main emission direction. In this case, the main emission direction is the emission direction in which the emitted light has an intensity maximum. For example, the main emission direction is perpendicular to an imaginary plane which covers the light exit opening.

In accordance with at least one embodiment of the lamp, the lamp comprises a lamp housing, which has a light exit opening. In addition, the lamp comprises a light source of a first type, which is arranged in the lamp housing. The lamp also comprises a lampholder, which is fastened on the lamp housing. Furthermore, the lamp comprises a light source of a second type, which is fastened on the lampholder. The light source of the second type in this case comprises an organic light-emitting diode or another light source and is arranged downstream of the light exit opening in an emission direction. Preferably, the lamp comprises at least two light sources of a second type. Preferably, all of the light sources of the second type of the lamp are arranged downstream of the light exit opening in an emission direction, for example, in a main emission direction.

In accordance with at least one embodiment of the lamp, at least one of the at least one light source of the second type is designed to be reflective, at least in some places. This light source of the second type can be designed to be reflective on its rear side remote from the emission side, for example. In addition, it is possible for the light source of the second type to also be designed to be reflective on its emission side. For example, this light source of the second type may then be a reflective organic light-emitting diode. The light source of the second type preferably has a reflectivity of at least 50%, preferably at least 70%, for example, 80% for visible light on its reflective faces.

The light emitted through the light exit opening in the lamp housing radiates onto the reflective light source of the second type during operation of the light source of the first type. This light impinges on the light source of the second type and is reflected, if it impinges on reflective faces of the light source of the second type. In other words, the light source of the second type, which is designed to be reflective at least in some places, not only actively emits light, but also reflects the light emitted by the light source of the first type through the light exit opening in the lamp housing. Since the light source of the first type is covered by the lamp housing and therefore the light source of the first type is not visible from the outside, it appears to the observer as though the light source of the second type emits more light than is actually the case. In this way, despite the use of relatively low-light organic light-emitting diodes, a lamp with a high luminous flux can be achieved.

It is possible in this case for precisely one single light source, a few light sources or all of the light sources of the second type to be designed to be reflective, at least in some places.

In accordance with at least one embodiment of the lamp, at least one of the at least one light source of the second type is designed to be transmissive to radiation, at least in some places. Light emitted during operation of the light source of the first type impinges on and can radiate through this light source of the second type. The light source of the second type, which is designed to be transmissive to radiation, may then be a radiation-transmissive organic light-emitting diode. The light from the first light source passing through the light source of the second type can mix with the light from the light source of the second type, with the result that mixed light is emitted overall. It is also true for light sources of the second type through which radiation passes that they appear to be brighter to the external observer than would be the case without the light from the light source of the first type radiating through.

In this case, it is possible for all of the light sources of the second type, some of the light sources of the second type, only a single one of the light sources of the second type or none of the light sources to be designed to be transmissive to radiation. That is to say that the lamp can comprise a mixture of light sources of the second type, with some of the light sources being designed to be reflective and some other of the light sources being designed to be transmissive to radiation. Furthermore, it is possible for the lamp to comprise only reflective light sources of the second type or only radiation-transmissive light sources of the second type.

In accordance with at least one embodiment of the lamp, the lamp housing has a first cavity, in which the light source of the first type is arranged, wherein an inner face of the first cavity, the inner face facing the light source of the first type, is designed to be reflective. Light which is generated during operation of the light source of the first type is reflected on the inner face of the cavity. Preferably, the light is reflected at least partially such that it passes to the light exit opening in the lamp housing. The inner face of the cavity, which is designed to be reflective, can have a shape which assists reflection in the direction of the light exit opening, for this purpose. For example, the inner face can be designed, at least in some places, in the manner of a compound parabolic concentrator, a compound elliptical concentrator or a compound hyperbolic concentrator. In addition, the first cavity can be in the form of a truncated pyramid or a truncated cone with reflective inner faces, at least in some places.

In addition to reflection towards the light exit opening in the lamp housing, the reflective inner face of the cavity can also be used for mixing the light generated by the light source of the first type before the light exit through the light exit opening. In this way, particularly homogeneous, for example, white light can be emitted through the light exit opening, even when the light source of the first type itself is designed to be inhomogeneous with respect to color. The light source of the first type can comprise light-emitting diode chips of different colors, for example, with the light from the light-emitting diode chips being mixed in the first cavity to form white light. In this case, there is no need for an additional diffuser.

In accordance with at least one embodiment of the lamp, the lamp housing comprises a first cavity which is designed in the manner of an ellipsoid, preferably an ellipsoid of revolution, in some places. "In the manner of an ellipsoid" means here that an inner face of the first cavity follows the form of an ellipsoid with a deviation of at most 15%, preferably at most 10%. Within the bounds of manufacturing tolerance, the inner face can follow the profile of an ellipsoid, at least in some places. "In some places" means that the cavity may in some regions not be in the form of an ellipsoid. For example, the cavity is designed in the manner of an ellipsoid which is cut away in the region of its focal planes along the focal planes.

The light source of the first type of the lamp is in this case preferably arranged in the vicinity of one focal point of the ellipsoid which is remote from the light exit opening of the lamp housing. The ellipsoid can be cut away in the region of the focal point, preferably along the focal plane. The light source is then preferably arranged such that the focal point lies in a plane in which a light exit opening of the light source is also located. Therefore, the light source can be arranged at the focal point of the ellipsoid of revolution.

In addition, the light exit opening is preferably arranged in the vicinity of the other focal point of the ellipsoid. For example, the cavity is open in the region of the other focal point and has the light exit opening there. The other focal point can then be located in the plane which terminates the light exit opening, for example.

Overall, it is thus possible to couple a particularly large proportion of the light generated by the light source of the first type out of the light exit opening in the lamp housing. The inner faces of the first cavity are preferably reflective for this purpose and reflect the light impinging on them, preferably directionally and not diffusely. By virtue of being reflected on the inner face of the cavity, the light is also mixed. If the cavity is in the form of an ellipsoid, preferably in the form of an ellipsoid of revolution, the light exit opening can additionally be selected to be relatively small.

For example, a maximum diameter of the light exit opening is at most twice as large as the diameter of the light exit opening of the light source. This makes it possible to ensure that the light source of the first type is barely visible, or is even not visible at all, from outside the lamp housing at most viewing angles. This increases the impression that all of the light emitted by the lamp is emitted by the light sources of the second type. If the light source comprises a plurality of inorganic light-emitting diode chips, for example, the diameter of the light exit opening of the light source is, for example, the diameter of the sum of the radiation exit faces of the light-emitting diode chips.

In accordance with at least one embodiment of the lamp, the lamp housing has a second cavity, which is arranged on a side of the first cavity which is remote from the light exit opening. A drive apparatus for the light sources of the first type and the light sources of the second type can be arranged in the second cavity, for example. The drive apparatus may be, for example, a pulse width modulation circuit, via which at least one of the light sources can be dimmed. The drive apparatus can furthermore have a memory apparatus, in which different light functions of the lamp are stored, it being possible for the light functions to be called up by a user from outside the lamp. For example, the lamp can thus be operated at different color temperatures and/or at different color loci.

In accordance with at least one embodiment of the lamp, the lamp housing has a basic body, which is designed in the manner of a truncated cone or a truncated pyramid or a cylinder, at least in some places. If the lamp housing is designed in the manner of a truncated cone or a truncated pyramid, it preferably tapers in a direction away from the light exit opening of the lamp housing. In this case, the lamp housing can also have a multi-part design. For example, the lamp housing can have a first region, in which it is designed in the manner of a truncated cone which tapers in the opposite direction to the direction of the light exit opening. In addition, the lamp housing can then have a second section, in which it is designed in the form of a cylinder, for example. The second section then adjoins the first section on that side of the first section which is remote from the light exit opening.

In accordance with at least one embodiment of the lamp, the lamp housing has a basic body and at least two cooling disks, which are fastened on the basic body spaced apart from one another. For example, the cooling disks are fastened on the basic body, spaced apart from one another in a vertical direction. The cooling disks can be cylindrical, for example. The cooling disks surround the basic body preferably laterally, for example, completely laterally. The cooling disks therefore increase the area of the outer face of the lamp housing and result in improved heat dissipation of the heat generated by the light source of the first type during operation. For example, the lamp comprises at least five, for example, eleven, cooling disks. The cooling disks can in this case also be designed integrally with the basic body or are mechanically connected to the basic body, for example, by means of welding. The cooling disks and the basic body can in this case be formed with a metal or a ceramic material.

In accordance with at least one embodiment of the lamp, the outer face of the lamp housing which surrounds the light exit opening is designed to be reflective, at least in some places. That is to say that, for example, the outer face of the basic body which laterally surrounds the light exit opening is designed to be reflective for light generated by the light sources, with the result that, in addition, light is reflected by this outer face in the direction of the light sources of the second type.

In accordance with at least one embodiment of the lamp, the lampholder of the lamp which is fastened on the lamp housing is provided for electrically connecting the at least one light source of the second type. For this purpose, the lampholder itself can be designed to be electrically conductive and a current for making electrical contact with the lamps of the second type is passed via the lampholder. In addition, it is possible for electrical lines to be laid within the lampholder, insulated from the lampholder, and for these electrical lines to be used for connecting the light source of the second type.

In accordance with at least one embodiment of the lamp, at least one of the light sources of the second type is mounted rotatably. For example, all of the light sources of the second type are mounted rotatably. For this purpose, the light sources can be fastened, for example, to the lampholder, for example, to at least one rod. In this way, the light sources of the second type can be aligned as desired by the user. If the light sources of the second type are designed to be reflective, in some places, for example, the user can determine the proportion and direction of the reflected light and the directly emitted light, for example, by rotating a light source of the second type. If a light source of the second type is designed to be transmissive to radiation, for example, the user can determine the proportion of light from the light source of the first type which passes through the light source of the second type and thereby adjust, for example, the color temperature and/or the color locus of the light emitted overall by rotating the light source of the second type.

In accordance with at least one embodiment of the lamp, the lampholder comprises at least two rods. In this case, the rods do not need to be straight, but can have kinks and/or turns. The light sources of the second type are then preferably mounted rotatably between at least two of the rods of the lampholder. In this way, the light sources of the second type can be aligned as desired by the user. If the light sources of the second type are designed to be reflective, in some places, for example, the user can determine, for example, the proportion and direction of the reflected light and the directly emitted light by rotating a light source of the second type. If a light source of the second type is designed to be transmissive to radiation, for example, the user can determine the proportion of light from the light source of the first type which passes through the light source of the second type and thereby adjust, for example, the color temperature and/or the color locus of the light emitted overall by rotating the light source of the second type.

In accordance with at least one embodiment of the lamp, the lampholder comprises at least one rod, which is designed in the manner of a sine function or in the manner of a cosine function, at least in some places. "In the manner of" means here that the rod deviates from the profile of the function by at most 15%, preferably by at most 10%. "In the manner of" a sine function or a cosine function in this case also includes the profile of the rod in the form of a helix. This means that at least one of the rods of the lampholder, for example, all of the rods of the lampholder, can be in the form of a helix. The rods can therefore be helices, cylindrical spirals or coils.

In accordance with at least one embodiment of the lamp, the lampholder comprises at least two rods, the profile of a second rod proceeding from the profile of a first rod and a rotation about the main axis of extent of the first rod. The main axis of extent of the first rod is in this case that axis which runs parallel to the direction in which the rod has its longest extent. In this embodiment, the rods of the lampholder can be designed to be geometrically similar to one another and to only differ in terms of the orientation in which they are fastened on the lamp housing. For example, a second rod proceeds from a first rod through a 180 degree of rotation of the first rod about the main axis of extent. The rods can then be fastened on the lamp housing offset with respect to one another, i.e., at different points.

In this case, it is in particular also possible for the lampholder to be designed in the manner of a two-start screw, the lampholder comprising two rods, which are each in the form of a helix. The lampholder therefore forms a double helix. The light sources of the second type are arranged between the two helices. The light sources of the second type can in this case be mounted rotatably between the two helices.

A lampholder which has two helices as fastening means for the light sources of the second type has proven to be particularly advantageous here since it is thus possible to ensure that light emitted from the light exit opening can impinge on a particularly large number of light sources of the second type in order to be reflected by the light sources or to radiate through the light sources. That is to say that the design of the lampholder with two helices between which the light sources of the second type are arranged provides the possibility of spatially particularly clever distribution of the light sources of the second type. In this case, the light exit opening is preferably arranged between the two rods in such a way that the longitudinal mid-axis does not intersect the rods of the lampholder through the light exit opening which is perpendicular to a light exit face of the light source of the first type, for example, but can pass through each of the light sources of the second type. Owing to the fact that they are fastened on the lampholder which comprises two helices, the light sources of the second type can be aligned in such a way that the light from the first light source is not shielded completely by any of the light sources of the second type and thus some of the light from the first light source can be radiated onto any light source of the second type.

BRIEF DESCRIPTION OF THE DRAWINGS

The lamp described here will be described in more detail below with reference to exemplary embodiments and the associated figures.

Identical, similar or functionally identical elements have been provided with the same reference symbols in the figures. The figures and the size ratios of the elements illustrated in the figures with respect to one another should not be considered as being to scale. In fact individual elements may be illustrated as being excessively large to improve illustration and/or understanding.

DETAILED DESCRIPTION OF ILLUSTRATIVE EMBODIMENTS

Figure 1A:
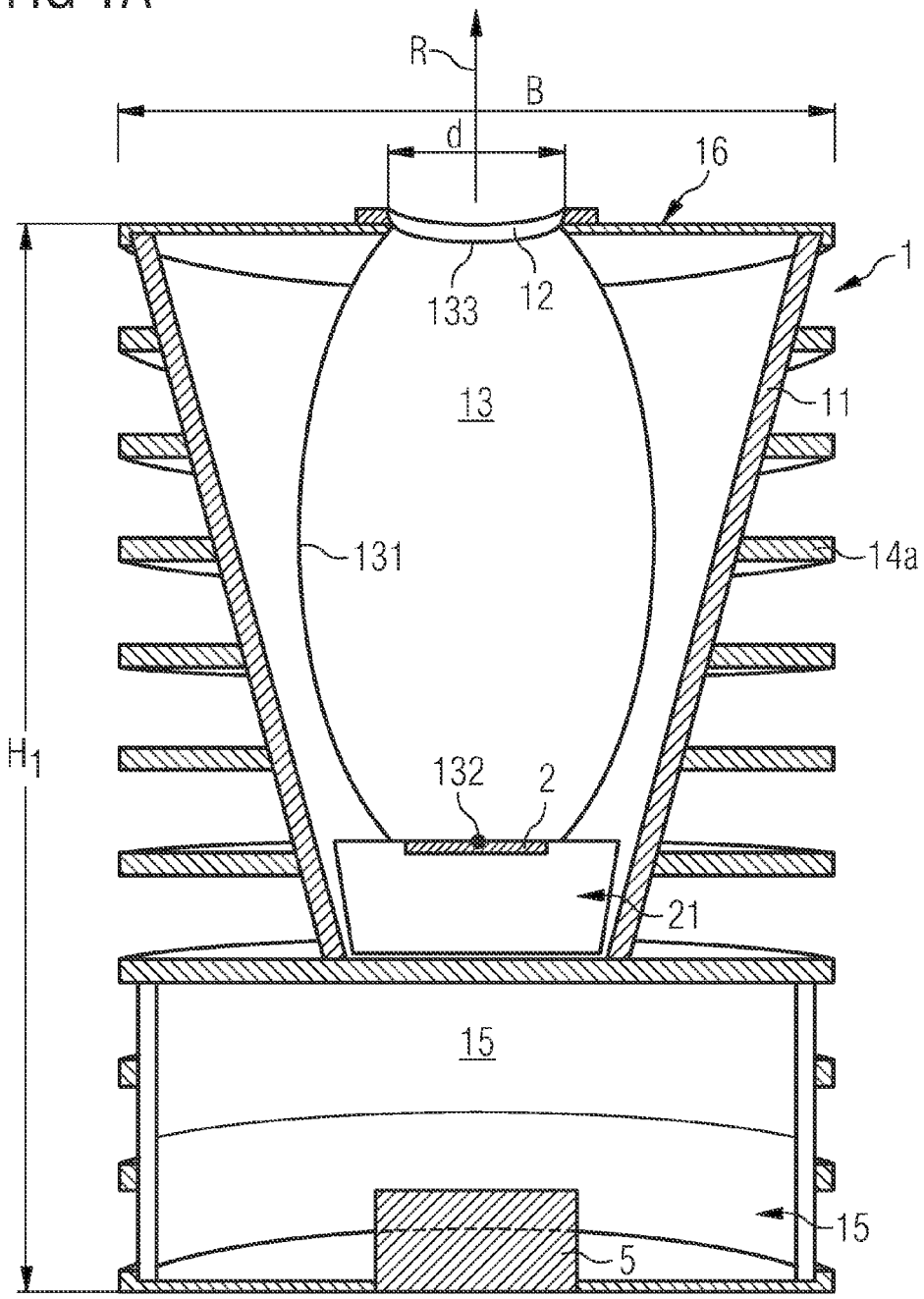
FIGS. 1A, 1B, 1C show schematic illustrations of lamp housings for exemplary embodiments of a lamp described here.

FIG. 1A shows a schematic sectional illustration of a lamp housing for an exemplary embodiment of a lamp described here. The lamp housing 1 comprises a basic body 11. The basic body 11 is formed with a metal, for example. The basic body 11 is formed in the manner of a truncated cone, in a first section, and in the manner of a cylinder in a second section.

The basic body 11 comprises cooling disks 14*a*, which are cylindrical and are fastened on the basic body, spaced apart from one another in a vertical direction. For example, the cooling disks 14*a* are designed to be integral with the basic body 11. The cooling disks 14*a* increase the outer surface area of the basic body 11 and therefore the lamp housing 1 and, therefore, serve to dissipate heat generated during operation of the lamp. The cooling disks 14*a* can surround the basic body 11 laterally in this case, in each case completely in the form of rings.

Figure 1B:
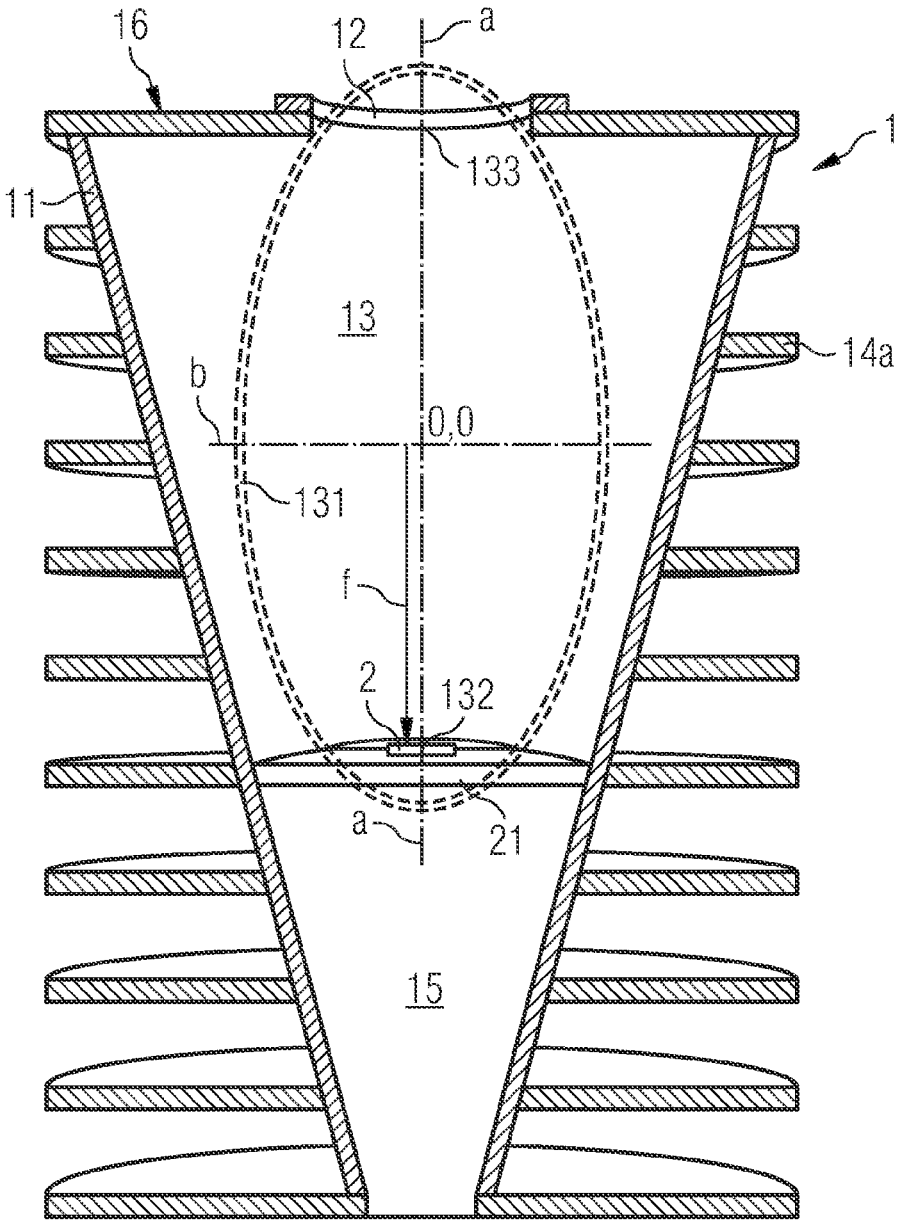
Figure 1C:
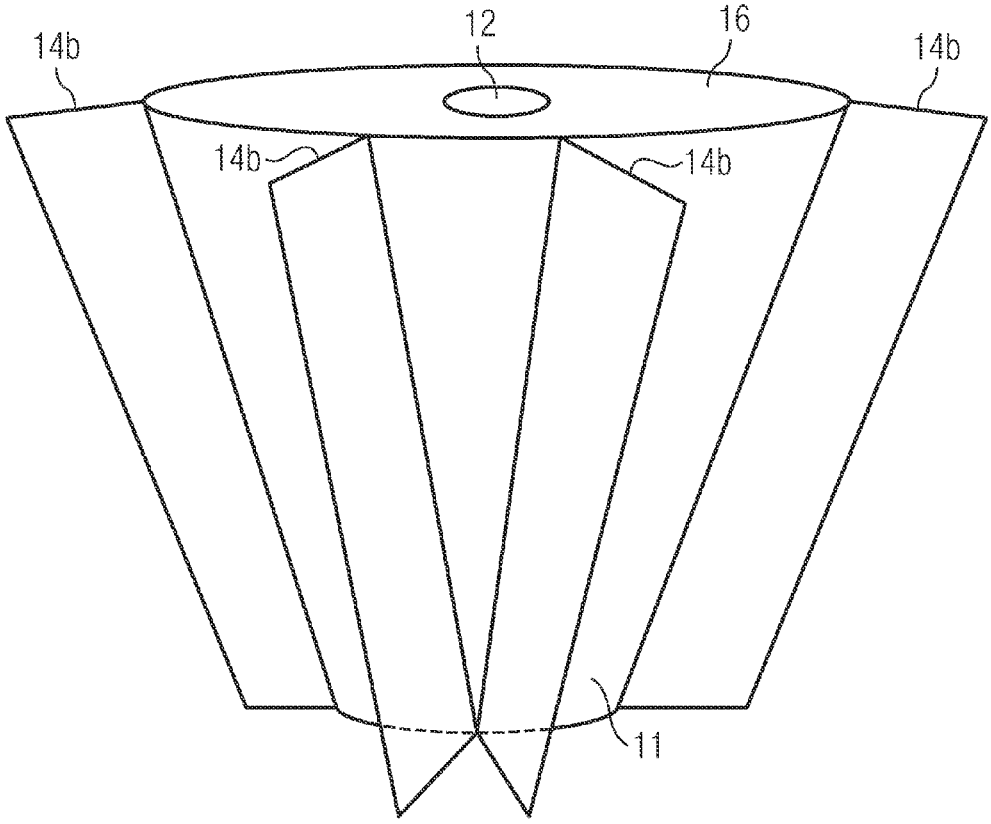

As a deviation from the exemplary embodiment illustrated in FIG. 1A, it is also possible for cooling ribs 14*b* to be fastened on the basic body 11, spaced apart radially, and for said cooling ribs to extend in the vertical direction (see the schematic perspective illustration in FIG. 1C). The cooling ribs 14*b* can in this case each be rectangular, for example. A combination of cooling ribs 14*b* and cooling disks 14*a* is also possible.

Furthermore, the basic body 11 comprises a first cavity 13. The first cavity 13 has an inner wall 131, which is designed to be reflective for visible light. The inner wall 131 of the first hollow body 13 is in the form of an ellipsoid of revolution, at least in some places. The ellipsoid of revolution has a first focal point 132 and a second focal point 133. The hollow body 13 is open on its longitudinal sides, i.e., in the region of the focal points 132, 133. The light source of the first type 2 is arranged at the first focal point 132. For example, a light exit opening of the light source 2 lies in the same plane as the first focal point 132.

The light exit opening 12, which is formed, for example, by an opening in the basic body 11 which can be covered by a piece of glass, is located at the second focal point 133. A plane which terminates the light exit opening 12 also comprises the second focal point 133, for example.

The light exit opening 12 has a diameter d, with this being the maximum diameter of the light exit opening, for example. The diameter d is in the range of between 25 mm and 35 mm, in this case 30 mm, for example.

The light source 2 comprises a heat sink 21 and light-emitting diode chips 22, 23 (see FIGS. 2A to 2F in this regard). Electromagnetic radiation generated during operation of the light source of the first type 2 is reflected on the inner walls 131 of the first cavity 13 in the direction of the light exit opening 12 and passes to the outside there.

As a deviation from this, it is also possible for the inner walls 131 to be designed to be non-reflective. The light source of the first type 2 may then be a light module which itself comprises an optical element for beam shaping and/or beam guidance, for example. The first cavity 13 is then a container which accommodates the light module.

The outer face 16 of the basic body 11 which surrounds the light exit opening 12 can be designed to be reflective. The width of the lamp housing B is between 110 mm and 130 mm, in this case 120 mm, for example. The height H1 of the lamp housing 1, i.e., the distance between the outer face 16 and that face of the lamp housing 1 which is opposite the outer face, is between 250 mm and 270 mm, in this case 260 mm, for example.

The basic body 11 of the lamp housing 1 has a second cavity 15. For example, a drive apparatus 5 for electrically operating and driving the light sources of the lamp can be provided in the second cavity 15.

In conjunction with the schematic sectional illustration in FIG. 1B, a lamp housing 1 for a further exemplary embodiment of a lamp described here will be explained in more detail. In this exemplary embodiment, the entire basic body 11 is in the form of a truncated cone which tapers in the opposite direction to the direction of the light exit opening 12. In conjunction with FIG. 1B, the design of the first cavity 13 in the form of an ellipsoid of revolution is also described in more detail. The ellipsoid of revolution has the axes a, b, which are selected to have a ratio of 2:1, for example. The ratio of the focal distance f in relation to the small axis b is then approximately 1.73:1. The eccentricity of the ellipsoid of revolution is then e=0.866.

Owing to the choice of the cavity 13 with its reflective inner wall 131 in the form of an ellipsoid, the light from the light source 2 is mixed particularly well before the light exit through the light exit opening 12. In addition, the light exit opening 12, which is arranged in the region of the second focal point 133, can be selected to be relatively small. For example, the maximum diameter d of the light exit opening 12 is at most twice as great as the maximum diameter d2 of the light exit face of the light source of the first type 2.

Figure 2A:
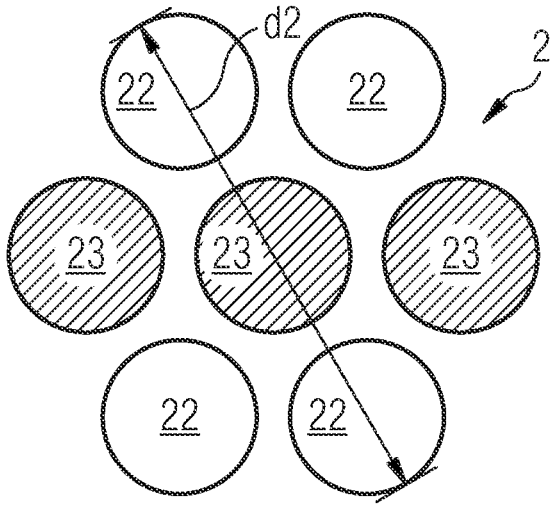
FIGS. 2A, 2B, 2C, 2D, 2E, 2F show light sources of a first type that are explained in more detail for exemplary embodiments of lamps described here.

FIG. 2A shows a schematic plan view of a light source of the first type 2, as is used in an exemplary embodiment of a lamp described here. The light source 2 comprises four first light-emitting diode chips 22 and three second light-emitting diode chips 23.

Figure 2B:
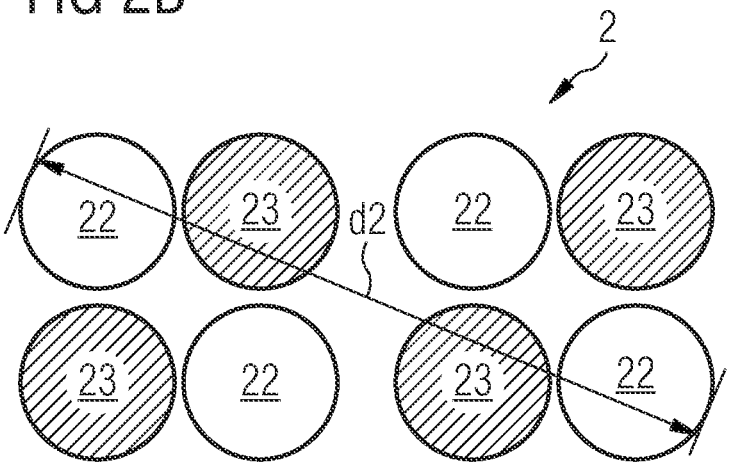

The schematic plan view in FIG. 2B shows an alternative light source 2 with in each case four first light-emitting diode chips 22 and four second light-emitting diode chips 23. For example, the light source of the first type 2 can comprise eight light-emitting diode chips, for example, four light-emitting diode chips 23 emitting red light and four light-emitting diode chips 22 emitting green-blue light. It is also conceivable for the light source of the first type 2 to comprise seven light-emitting diode chips, for example, two light-emitting diode chips emitting red light, two light-emitting diode chips emitting amber-colored light and three light-emitting diode chips emitting blue-green light.

The light source of the first type 2 is operated with a current of 700 mA, for example, and generates waste heat of at least 10 W, for example approximately 15 W. The lamp housing 1 is suitable for dissipating this waste heat, for example, owing to the cooling rings 14*b* on the basic body 11.

In FIGS. 2C to 2F, spectra are plotted graphically in each case, with the intensity I in arbitrary units being plotted against the wavelength λ in nm.

Figure 2C:
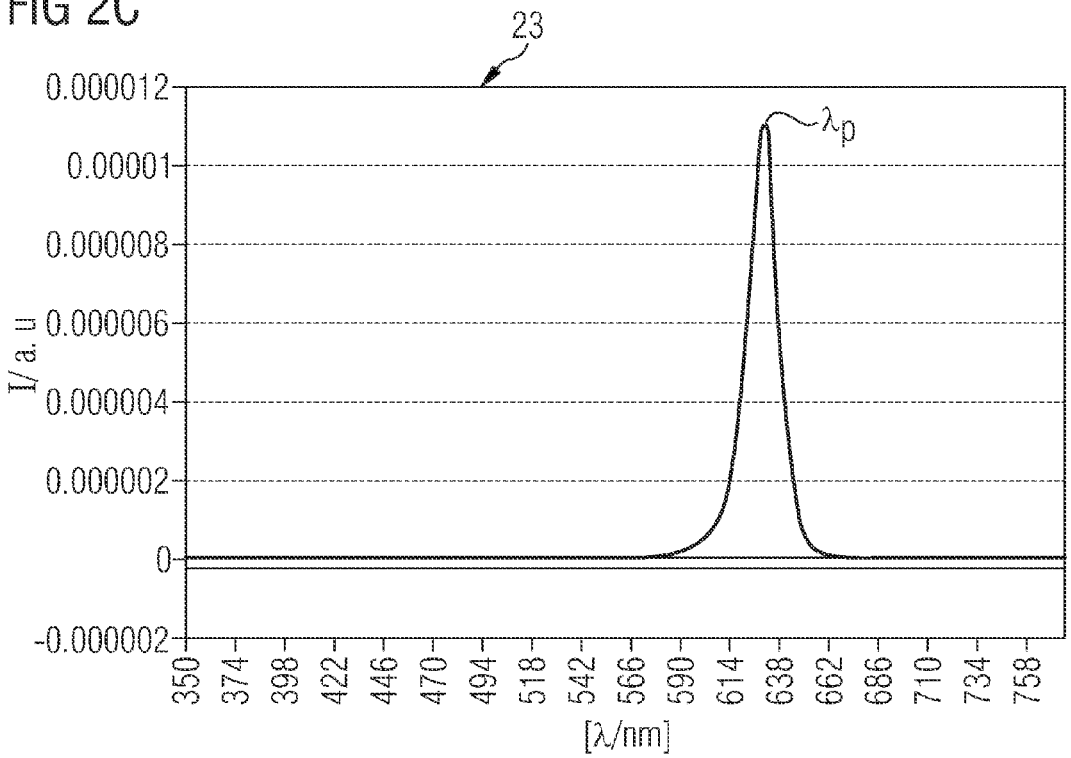
Figure 2D:
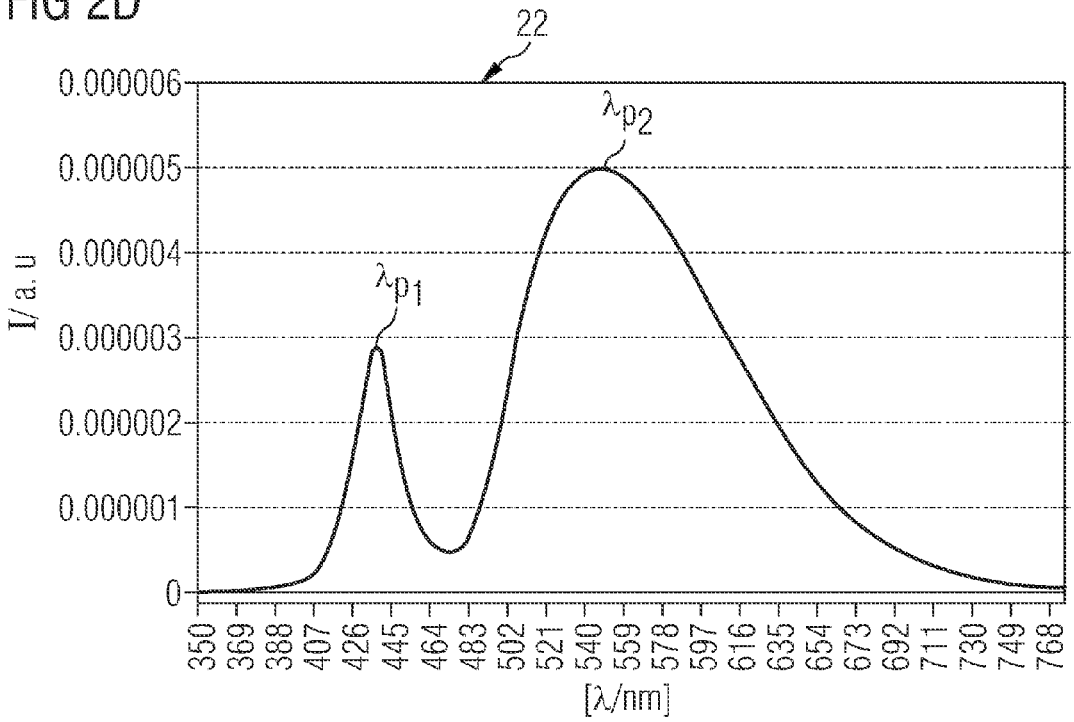
Figure 2E:
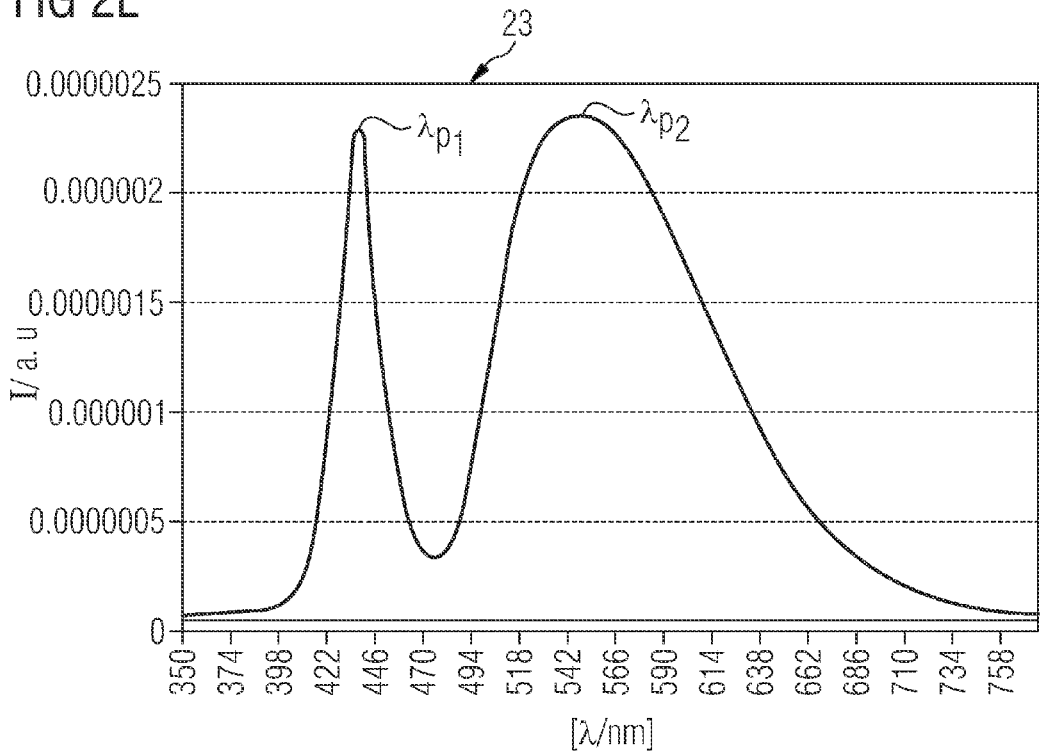
Figure 2F:
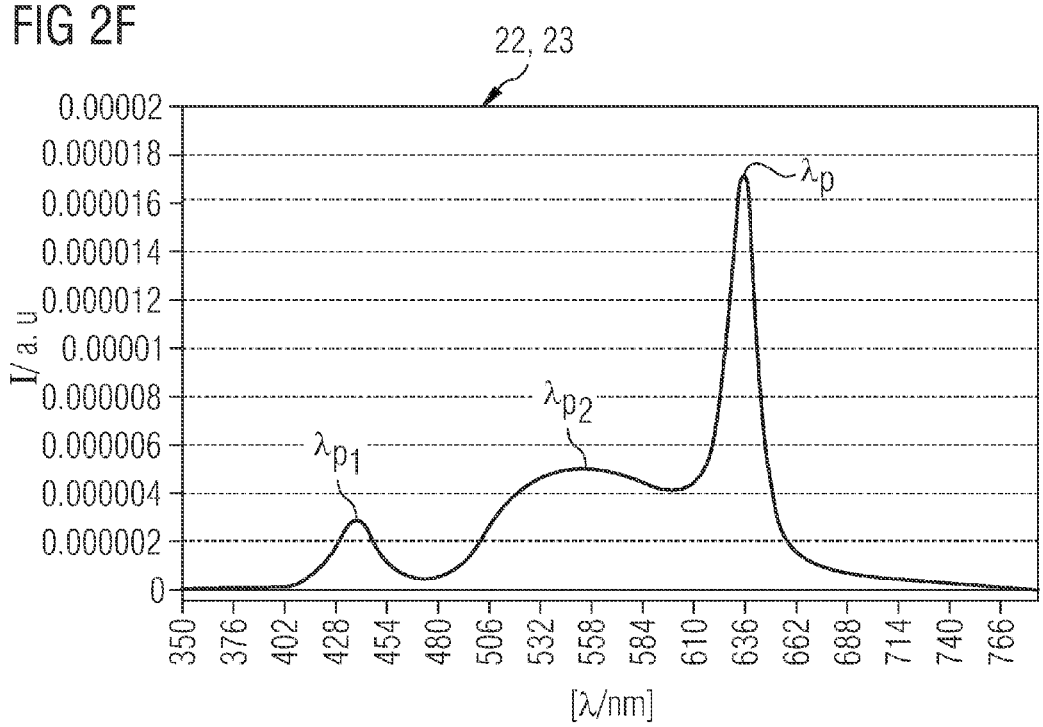

FIG. 2C shows, plotted graphically, the spectrum of second light-emitting diode chips 23, which have a peak wavelength λP in the region of red light. FIGS. 2D and 2E show two possibilities for the first light-emitting diode chips 22, which each have peak wavelengths in the region of blue light λP1 and green light λP2. FIG. 2F shows a resultant spectrum, for example, given the combination of light-emitting diode chips 22, 23 which are arranged as shown in FIG. 2B and have the spectra in FIGS. 2C and 2D. The color rendering index Ra of such a light source of the first type 2 is approximately 86. Preferably, the light emitted by the light source of the first type 2 has a color rendering index Ra of at least 80. The color temperature of the light emitted by the light source of the first type 2 is at least 2700 K, in this case approximately 2950 K, for example.

In the spectrum shown in FIG. 2F, the peak wavelengths λP1, λP2, λP of the two types of light-emitting diode chips 22, 23 are shown.

In order to achieve a desired color locus and/or a desired color temperature of the light emitted by the lamp, however, other light-emitting diodes and light sources of the first type other than those described can also be used.

Figure 3:
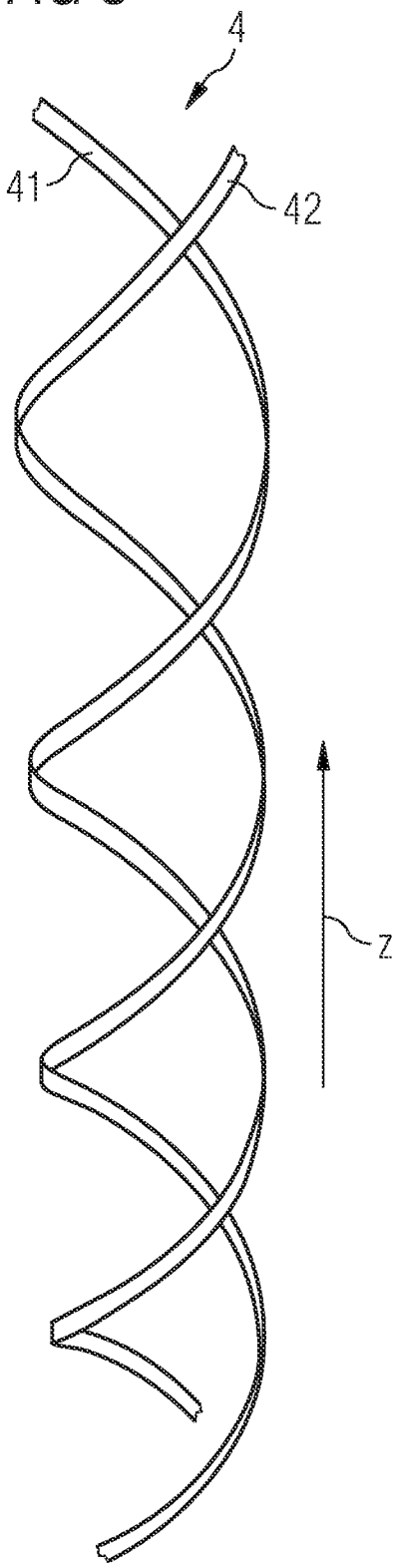
FIG. 3 shows a lampholder for an exemplary embodiment of a lamp described here and explained in more detail.

In conjunction with FIG. 3, a lampholder for an exemplary embodiment of a lamp described here is explained in more detail with reference to a schematic perspective illustration. FIG. 3 shows a lampholder 4, which comprises two rods 41, 42, which extend along their main axis of extent z. The two rods 41, 42 are each in the form of a helix. In this case, the rod 42 proceeds from the rod 41 by a rotation through 180° about the main axis of extent z, for example. The profile of the rod 41 may be described functionally as follows, for example: x=sin(t), y=cos(t), z=t. Overall, the lampholder 4 forms a two-start screw, which is formed by two helices 41, 42.

Figure 4A:
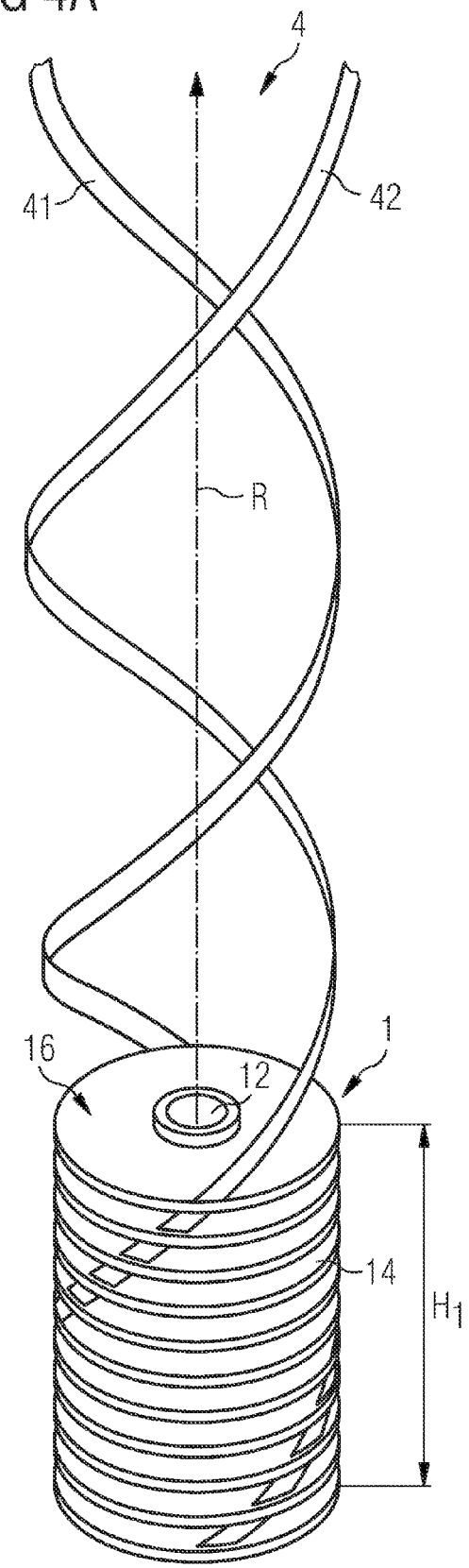
FIGS. 4A and 4B show an exemplary embodiment of a lamp described here and explained in more detail.

In conjunction with the schematic perspective illustration in FIG. 4A, it is demonstrated that the lampholder 4 is fastened mechanically on the lamp housing 1. The rods 41, 42 wind in this way around the main emission direction R of the light source of the first type 2, which runs parallel to the main axis of extent z of the rods 41, 42.

Figure 4B:
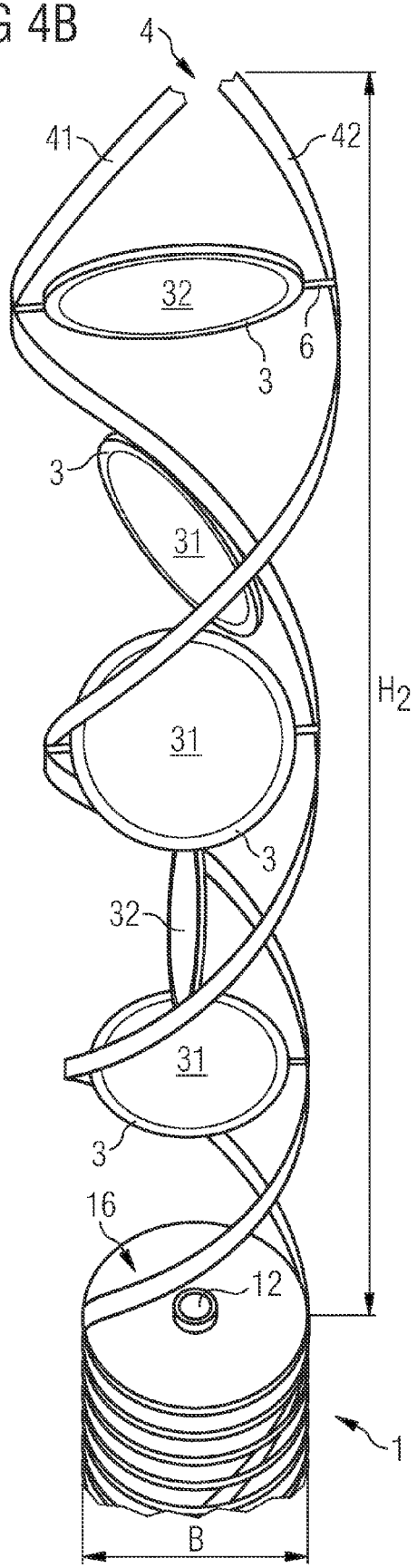

In conjunction with the schematic perspective illustration shown in FIG. 4B, an exemplary embodiment of a lamp described here is explained in more detail. The lamp housing 1 with the light exit opening 12 surrounds the lamp. The lampholder 4, which is in the form of a two-start screw, is fastened mechanically on the lamp housing 1. The rods 41, 42 of the lampholder 4 act as power supply lines for the light sources of the second type 3.

The lamp comprises six light sources of the second type, which are each formed by organic light-emitting diodes, for example. In this case, the light sources of the second type 3 comprise an emission side 31, from which electromagnetic radiation is emitted actively from the light sources of the second type 3. For example, the light sources of the second type 3 emit white light at a color temperature of between 2700 K and 2900 K, in this case 2800 K. The light sources of the second type 3 also comprise a rear side 32, which is remote from the emission side and is in this case reflective. The emission side 31 can also be designed to be reflective, with the result that the light sources of the second type 3 reflect light from the light source of the first type 2 which exits through the light exit opening 12 in the lamp housing 1.

The light sources of the second type 3 are mounted rotatably about the rotary spindles 6 and are fastened on both rods 41, 42 of the lampholder 4. Owing to the embodiment of the lampholder 4 in the form of a two-start screw, given a suitable arrangement of the light sources of the second type 3, light from the light source of the first type 2 can pass to each light source of the second type 3.

The height H2 of the lampholder is in this case at least 200 mm, for example 920 mm. The arrangement of the light sources of the second type 3 between the rods 41, 42 of the lampholder 4 also results in mechanical stabilization of the lampholder 4. By rotation about the rotary spindles 6 of the light sources of the second type 3, an emission characteristic of the lamp can be adjusted relatively freely. An adjustment of the color temperature and/or the color locus of the emitted light can also be performed by virtue of driving the light sources of the second type 3 and the light source of the first type 2. For example, it is thus possible to generate white light in the warm-white and cold-white region by means of the lamp.

Owing to the fact that the light from the light source of the first type 2 radiates onto the light sources of the second type 3, the light sources of the second type 3 appear to be overall brighter. This gives the impression that the overall emitted light from the lamp originates from the light sources of the second type 3.

In addition to the exemplary embodiment shown in FIG. 4B, in which the light sources of the second type 3 are designed to be reflective, at least in some places, it is also possible for the light sources of the second type 3 to be designed to be transmissive to radiation and to emit electromagnetic radiation both from their front side 31 and from their rear side 32. The light from the light source of the first type 2 then radiates through the light sources of the second type 3. This also gives the impression that the overall light generated by the lamp during operation originates from the light sources of the second type 3.

The invention is not restricted to the exemplary embodiments by the description with reference to the exemplary embodiments to. Instead, the invention includes any novel feature and any combination of features, which includes in particular any combination of features in the patent claims, even if this feature or this combination itself is not explicitly mentioned in the patent claims or exemplary embodiments.

The invention claimed is:

1. A lamp comprising:

a lamp housing, which has a light exit opening;

a light source of a first type arranged in the lamp housing;

a lampholder fastened on the lamp housing; and a light source of a second type fastened on the lampholder the light source of the second type comprising an organic light-emitting diode, and the light source of the second type arranged downstream of the light exit opening in an emission direction, wherein the light source of the second type is mounted rotatably and wherein the lampholder comprises at least two rods between which the light source of the second type is mounted rotatably.

2. The lamp according to claim 1, wherein the light source of the second type is designed to be reflective, at least in some places, and light emitted during operation of the light source of the first type impinges on and is reflected by the light source of the second type.

3. The lamp according to claim 1, wherein the light source of the second type is designed to be transmissive to radiation, at least in some places, and light emitted during operation of the light source of the first type impinges on and radiates through the light source of the second type.

4. The lamp according to claim 1, wherein the lamp housing has a first cavity, in which the light source of the first type is arranged, wherein an inner face of the first cavity facing the light source of the first type, is reflective.

5. The lamp according to claim 1, wherein the lamp housing has a first cavity designed as an ellipsoid of revolution, in some places, the light source of the first type being arranged in the vicinity of one focal point of the ellipsoid of revolution that is remote from the light exit opening, and wherein the light exit opening is arranged in the vicinity of another focal point of the ellipsoid of revolution.

6. The lamp according to claim 5, wherein the lamp housing has a second cavity arranged on a side of the first cavity remote from the light exit opening.

7. The lamp according to claim 1, wherein the lamp housing has a basic body in the form of a truncated cone or a truncated pyramid, at least in some places, wherein the truncated cone or the truncated pyramid tapers in a direction opposite to a direction of the light exit opening.

8. The lamp according to claim 1, wherein the lamp housing has a basic body and at least two cooling disks, the cooling disks being fastened on the basic body spaced apart from one another and surrounding the basic body laterally.

9. The lamp according to claim 7, wherein an outer face of the lamp housing that surrounds the light exit opening is reflective, at least in some places.

10. The lamp according to claim 1, wherein the lampholder is used for electrically connecting the light source of the second type.

11. The lamp according to claim 1, wherein the lampholder comprises at least one rod in the shape of a sinusoidal function, at least in some places.

12. The lamp according to claim 1, wherein the lampholder comprises first and second rods, a profile of the second rod proceeding from a profile of the first rod and a rotation about the main axis of extent of the first rod.

13. The lamp according to claim 1, wherein the lampholder is designed in the manner of a two-start screw, the lampholder comprising two rods, which are each in the form of a helix.

14. The lamp according to claim 6, further comprising a drive apparatus arranged in the second cavity, the drive apparatus configured to drive the light sources.

15. The lamp according to claim 1, further comprising a further light source of the second type arranged downstream of the light exit opening in the emission direction.

16. The lamp according to claim 15, wherein the lampholder comprises at least two rods, between which the light source of the second type and the second light source of the second type are mounted rotatably.

17. The lamp according to claim 1, wherein the lamp housing has a basic body and at least two cooling ribs, the cooling ribs being fastened on the basic body spaced apart from one another and surrounding the basic body laterally.

18. A lamp comprising:

a lamp housing, which has a light exit opening;

a light source of a first type, arranged in the lamp housing;

a lampholder, fastened on the lamp housing;

a light source of a second type, fastened on the lampholder, the light source of the second type being a flat light source, having an emission face with an area of at least 1 $cm^2$, the light source of the second type being arranged downstream of the light exit opening in an emission direction, wherein the lamp housing has a first cavity which is designed as an ellipsoid of revolution, in some places, the light source of the first type being arranged in the vicinity of one focal point of the ellipsoid of revolution that is remote from the light exit opening, and wherein the light exit opening is arranged in the vicinity of another focal point of the ellipsoid of revolution;

wherein the lamp housing has a basic body, in the form of a truncated cone or a truncated pyramid, at least in some places, wherein the truncated cone or the truncated pyramid tapers in a direction opposite to a direction of the light exit opening; and wherein the lampholder comprises at least one rod, in the form of a sinusoidal function, at least in some places.

* * * * *

UNITED STATES PATENT AND TRADEMARK OFFICE

CERTIFICATE OF CORRECTION

PATENT NO. : 8,876,332 B2
APPLICATION NO. : 13/392618
DATED : November 4, 2014
INVENTOR(S) : Martin Moeck It is certified that error appears in the above-identified patent and that said Letters Patent is hereby corrected as shown below:

On the Title Page, item 73 Assignee, line 1, delete "Osram Opto Semiconductor GmbH" and insert --Osram Opto Semiconductors GmbH--.

Signed and Sealed this
Seventeenth Day of May, 2016

Michelle K. Lee

Michelle K. Lee
*Director of the United States Patent and Trademark Office*